US005242318A

United States Patent [19]

Plass

[11] Patent Number: 5,242,318

[45] Date of Patent: Sep. 7, 1993

[54] MULTIPOLE CONNECTOR FOR ELECTRONIC SIGNAL LINES

[75] Inventor: Bernhard Plass, Lippstadt, Fed. Rep. of Germany

[73] Assignee: Filtec Filtertechnologie für die Elektronikindustrie GmbH, Lippstadt, Fed. Rep. of Germany

[21] Appl. No.: 898,474

[22] Filed: Jun. 15, 1992

[30] Foreign Application Priority Data

Jun. 14, 1991 [DE] Fed. Rep. of Germany ... 9107385[U]
Nov. 11, 1991 [EP] European Pat. Off. ..... 91119122.9

[51] Int. Cl.[5] ..... H01R 13/66
[52] U.S. Cl. ..... 439/620; 439/95
[58] Field of Search ..... 439/607, 620, 609, 95

[56] References Cited

U.S. PATENT DOCUMENTS

| | | | |
|---|---|---|---|
| 2,841,508 | 7/1958 | Roup et al. . | |
| 3,200,355 | 8/1965 | Dahlen . | |
| 3,447,104 | 5/1969 | Schot . | |
| 3,538,464 | 11/1970 | Walsh . | |
| 4,729,752 | 3/1988 | Dawson et al. | 439/620 |
| 4,791,391 | 12/1988 | Linnell et al. | 439/620 |
| 4,931,754 | 6/1990 | Moussie | 439/620 X |
| 4,959,626 | 9/1990 | Moussie | 439/620 X |
| 5,032,809 | 7/1991 | Chambers et al. | 439/620 X |

FOREIGN PATENT DOCUMENTS 2422268 11/1979 France .

*Primary Examiner*—Eugene F. Desmond
*Attorney, Agent, or Firm*—Herbert L. Lerner; Laurence A. Greenberg

[57] ABSTRACT

A multipole connector includes a housing having at least one conductive shell. Signal lines with pins extend through the housing, especially for carrying digitized signals. A base plate is disposed in the housing and is formed of aluminum-oxidic or ferromagnetic ceramic. A planar filter is mounted on the base plate in the housing. The planar filter has one capacitor for each of the pins of at least some of the signal lines. The capacitors are formed by a base electrode applied to the base plate, a dielectric layer applied onto the base electrode, and a counter electrode applied onto the dielectric layer. One of the electrodes is continuously constructed as a ground electrode and is conductively connected to the housing. The other of the electrodes is subdivided into individual signal electrodes and is conductively connected to the signal lines. The base plate, the dielectric layer and at least one of the electrodes have recesses formed therein forming ducts for the signal lines. The base electrode has further recesses formed therein around and in the vicinity of the ducts. The dielectric layer has bridges being extended through the further recesses and being in communication with and anchored to the material of the base plate.

33 Claims, 10 Drawing Sheets

MULTIPOLE CONNECTOR FOR ELECTRONIC SIGNAL LINES

Figure 1:
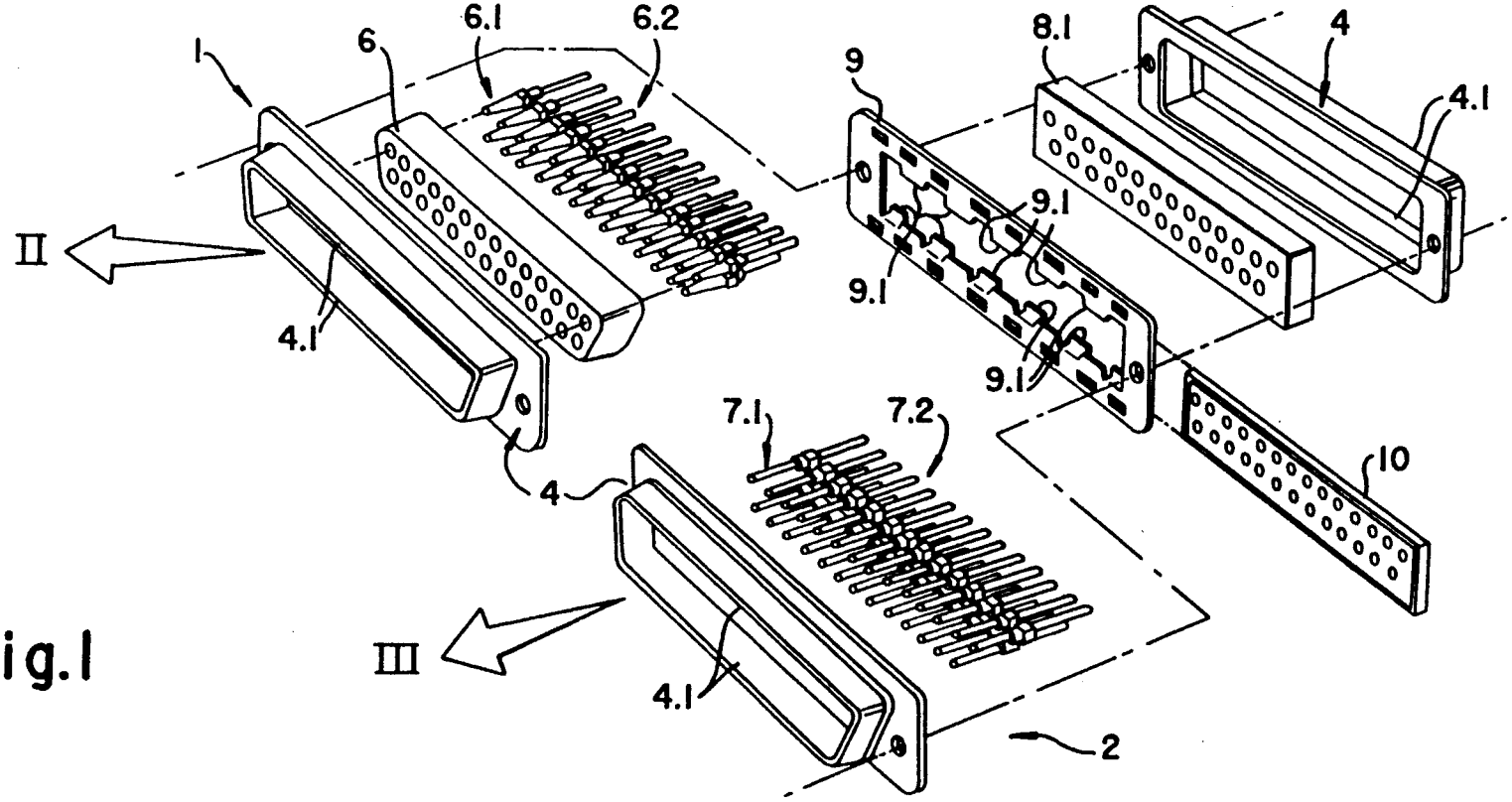

The invention relates to a multipole connector including a housing having at least one conductive shell through which lines extend, in particular for carrying digitized signals, a planar filter mounted on a base plate in the housing, capacitors for at least some of the signal lines, the capacitors being formed by a base electrode applied to the base plate, a dielectric layer applied to the base electrode and a counter electrode applied onto the dielectric layer, one of the electrodes being continuously constructed as a ground electrode and conductively connected to the housing and the other of the electrodes being subdivided into individual signal electrodes and conductively connected to the signal lines, and the base plate, the dielectric layer and at least one of the electrodes having recesses for ducting the signals lines.

In electronics, in particular in data processing, multipole connectors serve to transmit signals from one electronic unit to another, for example from a first computer to a second. In such a signal transmission, the signals are transmitted over cables connected to the equipment in the form of pulses at a (relatively) high bit rate. This transmission is interfered with by substantially higher bit rates, in the MHz range, of the computer, with pulse edges that correspond to even higher frequencies, so that the transmission range is reduced, especially over parallel interfaces. Noise fields in the environment also contribute to the interference that arises. Such electromagnetic noise fields, that are more or less damped by shielding provisions, also cause unwanted signals that lead to errors in signal transmission. In order to eliminate the interference, and in particular internal interfering factors in the equipment itself, multipole connectors have already been proposed, for instance in U.S. Pat. Nos. 2,841,508; 3,200,355; 3,447,104; and 3,538,464 and Published French Application No. 78.10242. In those proposals, a planar filter made essentially of capacitors is incorporated into the multipole connector. The capacitors are switched from the signal line to a ground electrode and act as low-pass filters. In those proposed planar filters, a ceramic substrate is provided with a first electrode, which is electrically conductively connected to the housing and onto which an insulating layer is applied that forms the dielectric of the capacitor, and onto which a counter electrode is in turn applied that is conductively connected to the signal line. In the event of temperature differences, problems arise in such a case, that are expressed in the form of mechanical strains between the substrate and above all the dielectric layer, because of differing temperature expansion coefficients.

It is accordingly an object of the invention to provide a multipole connector for electronic signal lines, which overcomes the hereinafore-mentioned disadvantages of the heretofore-known devices of this general type and which further develops such filter inserts that are integrated into the multipole connectors as low-pass filters that are capable of withstanding temperature differences without failures. It is a further object to provide multipole connectors that are intended to be further developed to make pi filters which reliably filter out high-frequency interference.

With the foregoing and other objects in view there is provided, in accordance with the invention, a multipole connector, comprising a housing having at least one conductive shell; signal lines with pins extending through the housing in particular for carrying digitized signals; a base plate being disposed in the housing and being formed of a material selected from the group consisting of aluminum-oxidic and ferromagnetic ceramic; a planar filter mounted on the base plate in the housing; the planar filter having one capacitor for each of the pins of at least some of the signal lines, the capacitors being formed by a base electrode applied to the base plate, a dielectric layer applied onto the base electrode, and a counter electrode applied onto the dielectric layer, one of the electrodes being continuously constructed as a ground electrode and being conductively connected to the housing, the other of the electrodes being subdivided into individual signal electrodes and being conductively connected to the signal lines; the base plate, the dielectric layer and at least one of the electrodes having recesses formed therein forming ducts for the signal lines; the base electrode having further recesses formed therein around and in the vicinity of the ducts; and the dielectric layer having bridges being extended through the further recesses and being in communication with and anchored to the material of the base plate.

As a result of this embodiment, each of the signal lines is provided with a capacitor that dissipates to the ground electrode and is capable of acting as a flow-pass filter by itself. Anchoring the material of the dielectric layer, generally a titanate, such as barium titanate, to the aluminum-oxidic or ferromagnetic ceramic substrate is made possible by means of the recesses in the region of each of the pin recesses, through which a direct material contact between these two layers is established. Using a ferromagnetic ceramic, which is possible in addition to the use of aluminum-oxidic ceramic, increases the series inductance of the signal line extending through the ceramic substrate, so that the low-pass filtering action is reinforced.

In accordance with another feature of the invention, the further recesses of the base electrode surround the duct recess in a grid-like manner, and at least some of the further recesses are located on the center line between two adjacent duct recesses. Placing the anchoring locations around the signal line duct in this way increases its symmetry, makes it easier to manufacture, and thus also improves its resistance to temperature change. Such structures are produced by typical thick-film manufacturing processes, such as coating by means of screen printing, or by means of photolithography, involving the application of photoresist, exposure with a template that has the structure, and dissolution and/or etching of the unexposed regions. The further recesses surround the duct recesses or duct electrodes and are also disposed between them.

In accordance with a further feature of the invention, the metallization that forms the continuous or common electrode is extended up to at least one edge of the base plate, and the metallization that forms the individual electrodes connected to the signal lines is extended as far as a location inside the duct recesses, in order to form corresponding contact strips. With this extension of the metallization on the insulating substrate, a simple capability is created of establishing the electrically conductive connection between the electrode acting as the signal electrode of the capacitor and the signal line to be connected, for instance by means of an immersion soldering process.

In accordance with an added feature of the invention, for forming a corresponding contact strip, the metallization that forms the continuous or common electrode is extended as far as at least one preferably metallized edge of the base plate.

In accordance with an additional likewise preferred feature of the invention, in order to form corresponding contact strips, the metallization that forms the individual electrodes connected to the signal lines is extended as far as a location inside the individual duct recesses for the signal lines.

With these embodiments, a configuration is created that can be bonded in a simple manner.

In accordance with yet another feature of the invention, the edge strips are metallized with solder paste that is typical in screen printing technology, so that when the individual electrodes are soldered to the signal lines, the edge melts on together with them and thus forms a gap-free coating.

In accordance with yet a further feature of the invention, the melted-on metallization is additionally coated with a conductivity paint. Due to this gapless paint coating, the thus-prepared filter insert can be inserted into a carrier with good contact, even if dimensional deviations occur or if there are slight deformations, possibly caused by temperature fluctuations.

In accordance with yet an added feature of the invention, for bonding purposes, whether by soldering or by means of clamp contacts, there is provided a metal filter carrier having contact tongues for holding the planar filter, the contact tongues pressing on the preferably metallized edges of the base plate of the planar filter for establishing the electrical contact with the continuous or common electrode. Thus a filter carrier is created that on one hand receives the planar filter in such a way that the filter carrier is in electrical contact with the continuous or common electrode, thus enabling through-bonding in a simple manner, and the contact is maintained even if thermal expansion occurs.

In accordance with yet an additional feature of the invention, the filter carrier is preferably form-lockingly inserted into at least one shell of the two-shell housing of the multipole connector in such a manner that the metal filter carrier and the housing shell are electrically conductively connected. This embodiment permits simple manufacture of the complete planar filter, that subsequently (or in the event of a failure on the occasion of its replacement) is inserted into the metal carrier, which is then in turn inserted into the metal housing or into one of its half-shells, and electrically conductively connected to the shell and thus to the common ground electrode through the contact tongues and/or the clamping action in the shell, without requiring soldering. Then, the elasticity of the contact tongues and/or of the metal shell compensate for any dimensional deviations that may occur, for instance from thermal expansion. A form-locking connection is one which connects two elements together due to the shape of the elements themselves, as opposed to a force-locking connection, which locks the elements together by force external to the elements.

In accordance with again another feature of the invention, the bonding is provided by applying or pressing against a conductive inlay being formed of an electrically conductive plastic or rubber or the like, which is disposed between the metal filter carrier and the planar filter. Upon installation, the planar filter is placed on this electrically conductive inlay and also presses against it upon closure of the filter carrier, so that secure bonding that is also adequate for the purpose of the filter is provided. Advantageously, the conductivity of this inlay is in the range of $10^3$ S. It is sufficient for the inlay to be constructed as a surrounding frame. Once again, secure bonding is attained by means of the large-area contact with the elastic inlay. The bonding is maintained even in the event of dimensional deviations caused by thermal expansion.

In accordance with again a further feature of the invention, the planar filter inserted into the filter carrier is provided with a covering of plastic or rubber, which is provided with through holes for the signal lines. With this configuration, bonding is effected through the contact tongues, which are in direct contact with the filter housing, or through the electrically conductive inlay. The planar filter and especially the capacitors are protected, particularly from impacts, by this covering that forms a support.

In accordance with again an added feature of the invention, the base electrode being applied to the base plate and being provided with the duct recesses and the further recesses, is continuous as far as the preferably metallized edge of the base plate and on the edge forms the contact strip being connectable to the filter carrier as the ground electrode, the counter electrode being applied to the dielectric layer for each signal line, is drawn inward in approximately cup-like fashion as far as the height of the surface of the base plate in the region of the ducts and is extended as far as the inside of the ducts in the form of a contact strip for connection with the signal lines, and the recesses in the base electrode for the connecting bridges surround the ducted signal lines approximately in grid-like fashion in a spaced apart manner.

In accordance with again an additional feature of the invention, as an alternative, the base electrode being applied to the base plate and being provided in the duct recesses and the further recesses, is subdivided into individual electrodes and extended in the region of the ducts as far as a location inside them, forming the contact strips of the signal electrodes for connection with the signal lines, the counter electrode being constructed as a continuous ground electrode, is drawn inward in the edge regions approximately in the manner of a shallow cake pan up to the height of the base plate and extended to its preferably metallized edge, forming the contact strip, and is connectable to the filter carrier, and the recesses in the counter electrode surround the signal lines in a spaced-apart manner.

In the first embodiment, the electrode applied in planar fashion to the substrate is constructed as a ground electrode that is extended as far as the edges of the base plate, and the signal electrodes form individual "islands" that surround the pins of the signal lines. In the second embodiment, this is precisely reversed, in that the ground electrode is applied to the dielectric, while the signal electrodes, which once again form "islands" located around the pins of the signal lines, rest on the base plate and have the approximately grid-like structure. The various spacings assure that electrical connections are avoided.

In accordance with still another feature of the invention, the counter electrode, which is applied to the dielectric layer, is covered with an insulating coating, and the connections to the signal lines, which are constructed as soldering locations, are preferably recessed. Through the use of this covering, the influence of moisture deposits is reduced, and a silicone resin is advantageously used as the coating.

In accordance with still a further feature of the invention, there are provided voltage-peak-suppressing circuit elements for at least some of the signal lines.

In accordance with still an added feature of the invention, the voltage-peak-suppressing circuit elements are Zener or avalanche diodes or varistors, preferably being soldered into place on the side of the base plate remote from the capacitors, between the contact strip on its edge and the contact strip of the duct of the signal line. Through the use of this embodiment, the inserted planar filter intercepts voltage peaks and thus protects the electronics connected to its output side. Through the use of such components, voltage peaks can be limited in such a way that any damage extending beyond mere interference, for instance at the input to a corresponding computer or at a printer input, is avoided.

In accordance with still an additional feature of the invention, at least some of the signal lines, on at least one of the sides of the planar filter disposed in the filter holder, and preferably on both sides, are provided with a damping element, in the form of a ferrite bead or the like, that increases the series inductance, to form an L-type or T-type filter configuration.

In accordance with another feature of the invention, the damping element increasing the series inductance is a pin receptacle formed of a ferromagnetic material, preferably a ferromagnetic ceramic. These beads or hollow cores of a ferromagnetic ceramic, which are placed over the pins of at least some of the signal lines in addition to a ferromagnetic ceramic substrate, increase the series inductance of the applicable signal line, so that the filter action of the transverse capacitor is increased by the formation of corresponding L-type or T-type filter configurations, and the limit frequency or frequencies are shifted to the desired range, and optionally toward lower values.

In accordance with a further feature of the invention, the housing has a first and a second shell; in one of the shells, the plug-type connections for the signal lines are constructed as plug-in pins, and in the other of the shells they are constructed as tip jacks, or as plug-in pins, in such a way that the connector can be used as an adaptor plug. Signal lines from the plug-in pins or tip jacks of the plug connector part inserted into the first housing shell are connected to those of the second connector part. With the use of this kind of double-shell housing, adaptor plugs or couplings can be produced that are capable of suppressing interference and preventing the penetration of high-frequency interference, for instance from a computer connected thereby, when provided with filters and incorporated in the course of the line.

In accordance with an added feature of the invention, the connections of the pins of the signal lines of the connector part inserted into the first housing shell are connected to the pins of the signal lines of the second connector part in such way that a change in the occupation of the various signal lines is made, so that the connector can be used as an adaptor.

The structure of the adaptor, according to one feature of the invention, also makes it possible to provide electronic components as adaptation elements, at least in some connections between the signal lines of the first shell and the signal lines of the second shell of the housing. With this kind of embodiment, an adaptation to different line configurations can be made, and moreover an adaptation even to individual lines can be performed.

In accordance with a concomitant feature of the invention, one planar filter is disposed in each of the shells of the housing, and at least some of the signal lines are provided, between these planar filters, with additional ferromagnetic damping elements in the form of hollow cores or beads, being slipped onto the signal lines, which increase their series inductance, and when disposed between the transverse capacitors form a pi-type filter being effective for the thus-wired signal line. With such a pi filter, effective filtering out of high-frequencies is attainable with an adequately delineated frequency limit. This is an advantage that improves the low-pass filtering properties of the multipole connector provided with a filter.

Other features which are considered as characteristic for the invention are set forth in the appended claims.

Although the invention is illustrated and described herein as embodied in a multipole connector for electronic signal lines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2A:
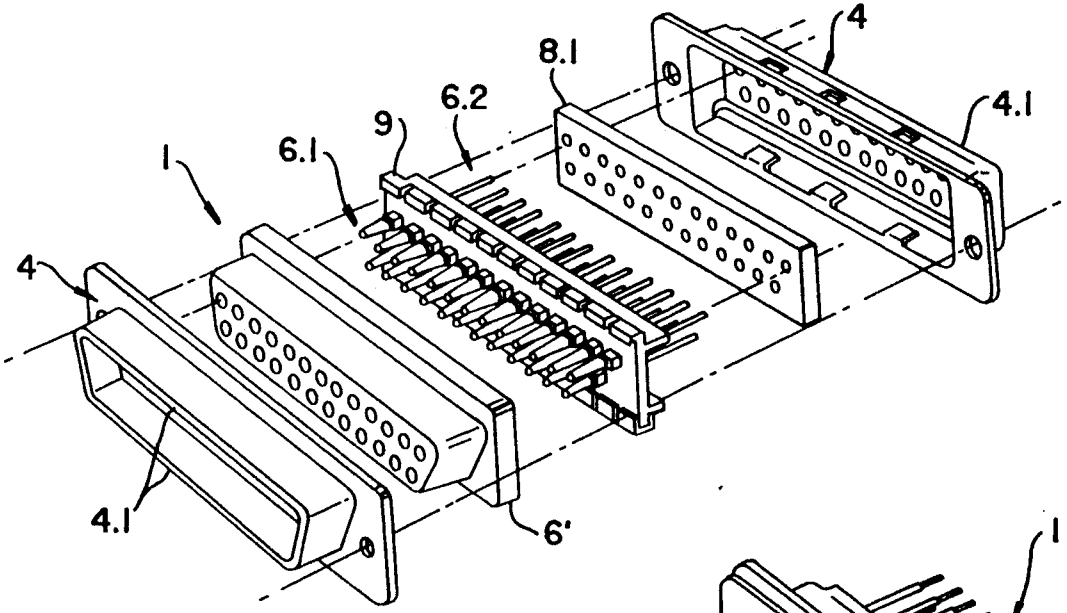
Figure 2B:
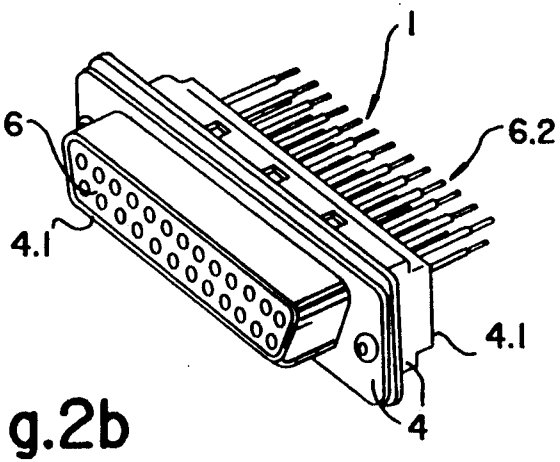
Figure 2C:
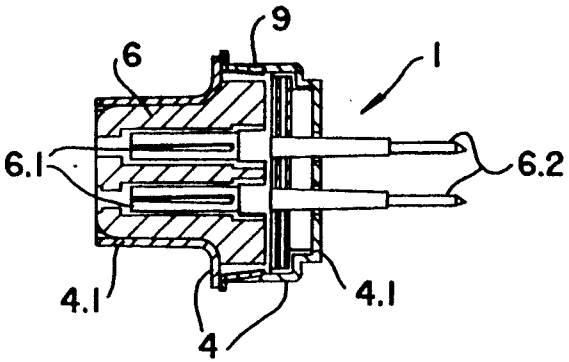
Figure 3A:
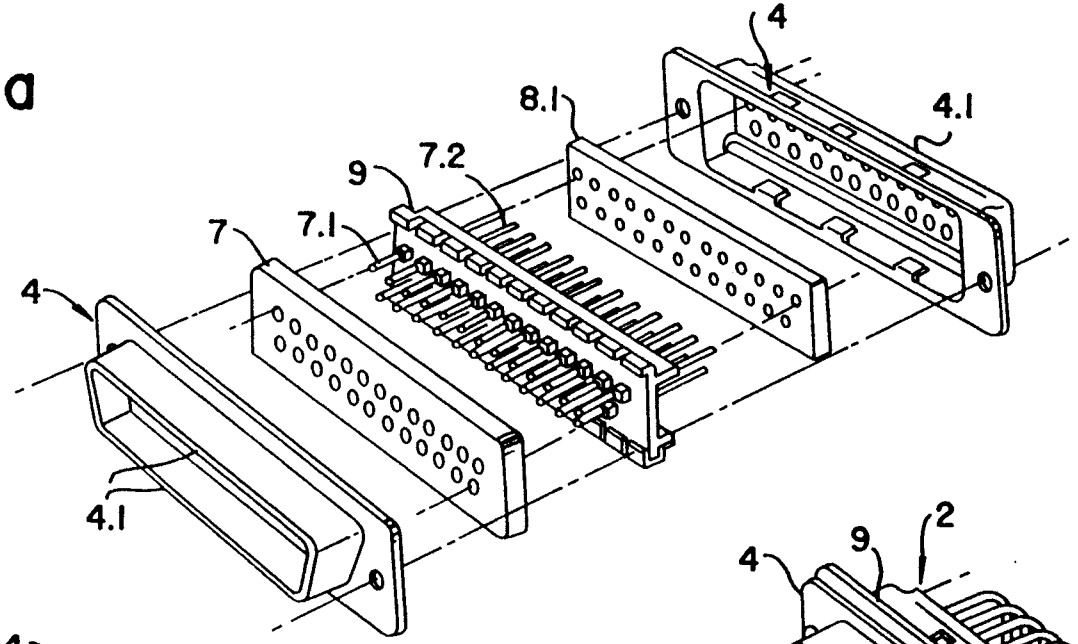
Figure 3B:
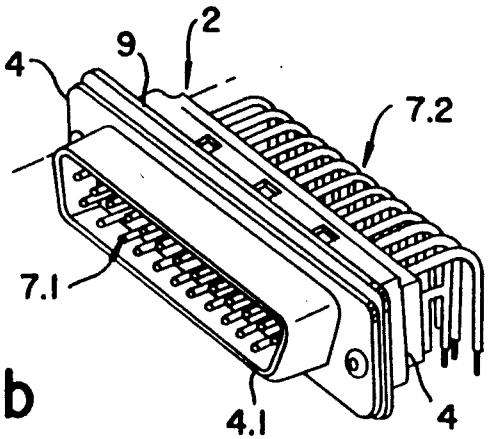
Figure 3C:
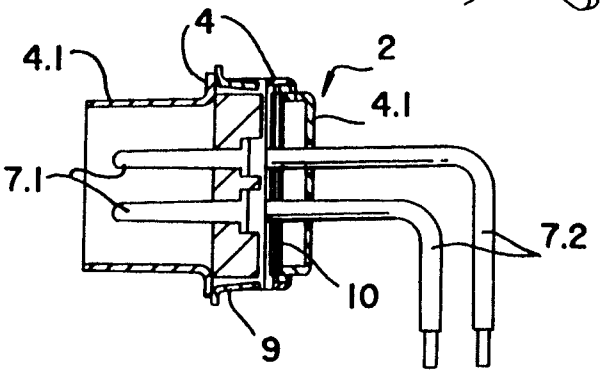
Figure 4B:
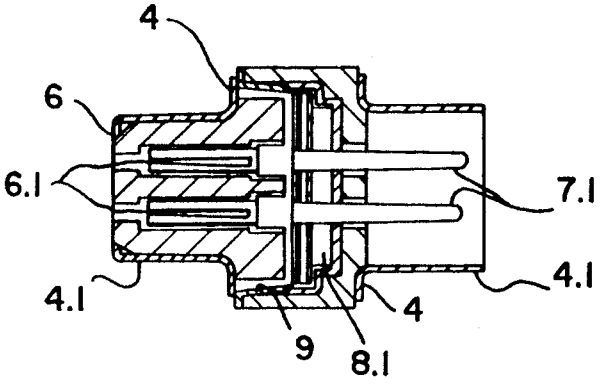
Figure 4C:
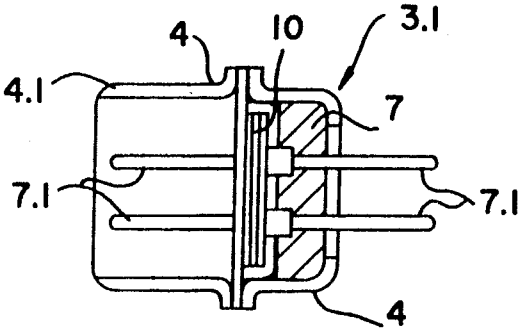
Figure 4A:
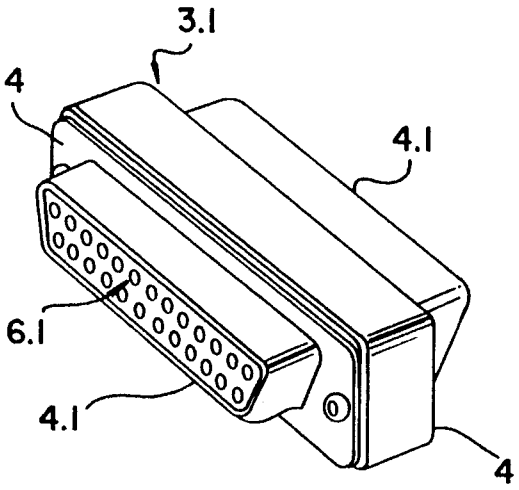
Figure 5A:
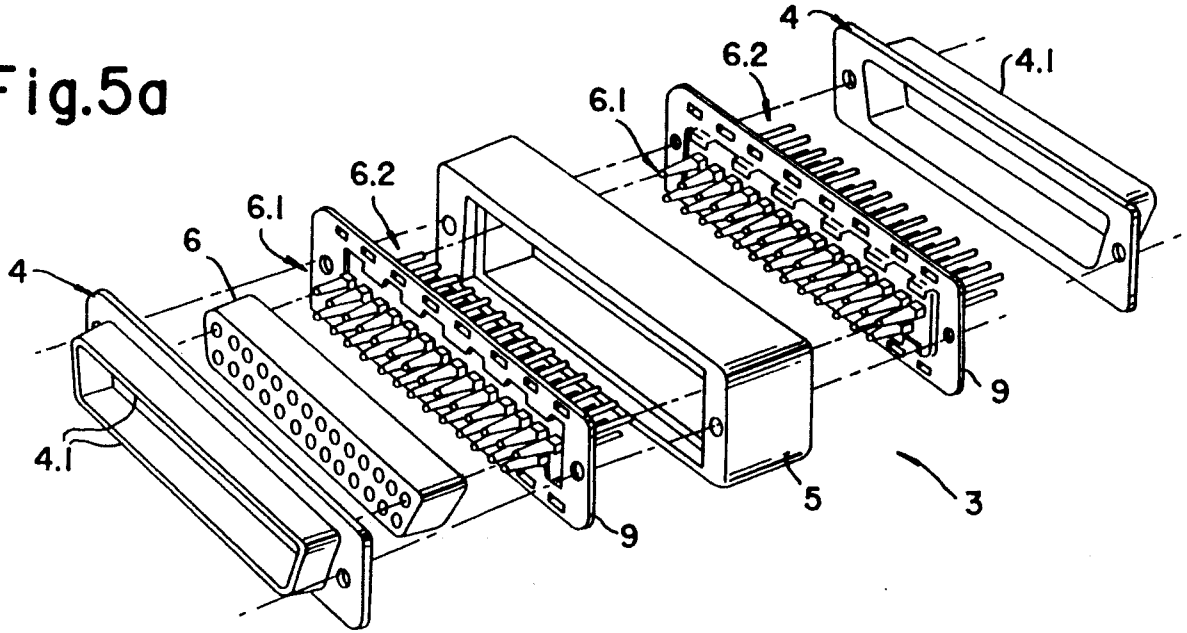
Figure 5C:
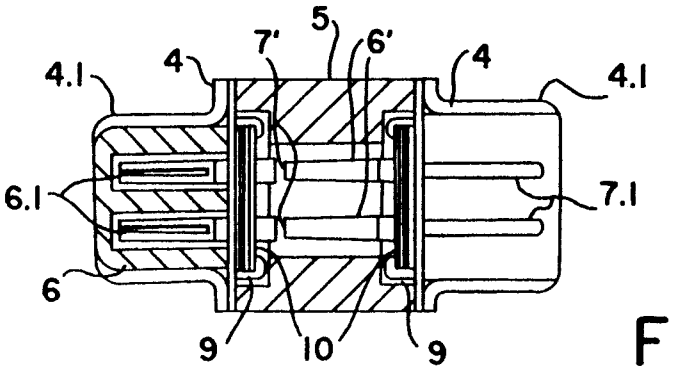
Figure 5B:
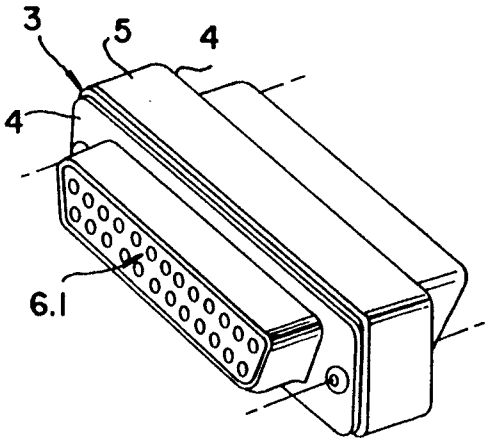
Figure 6A:
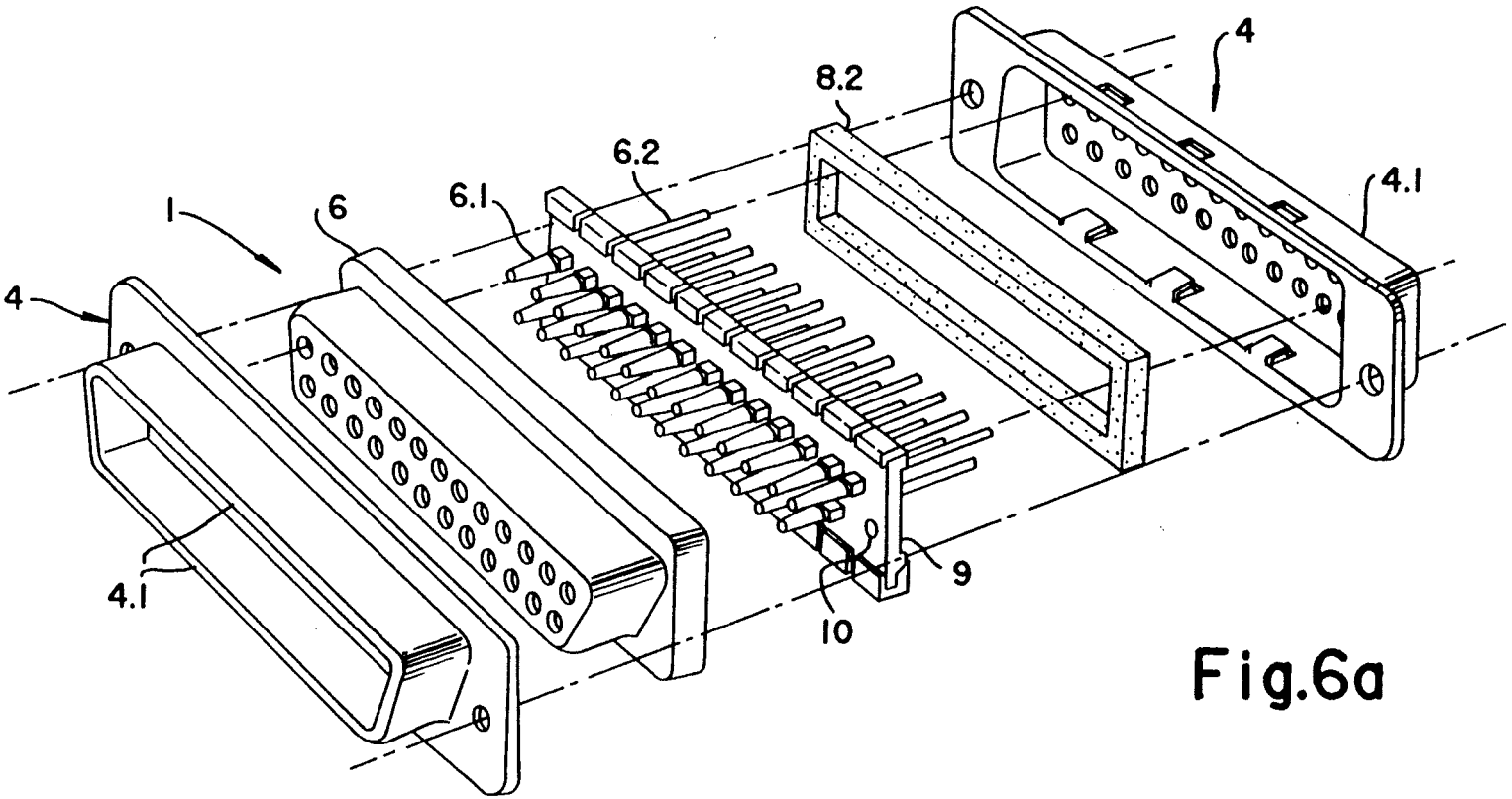
Figure 6B:
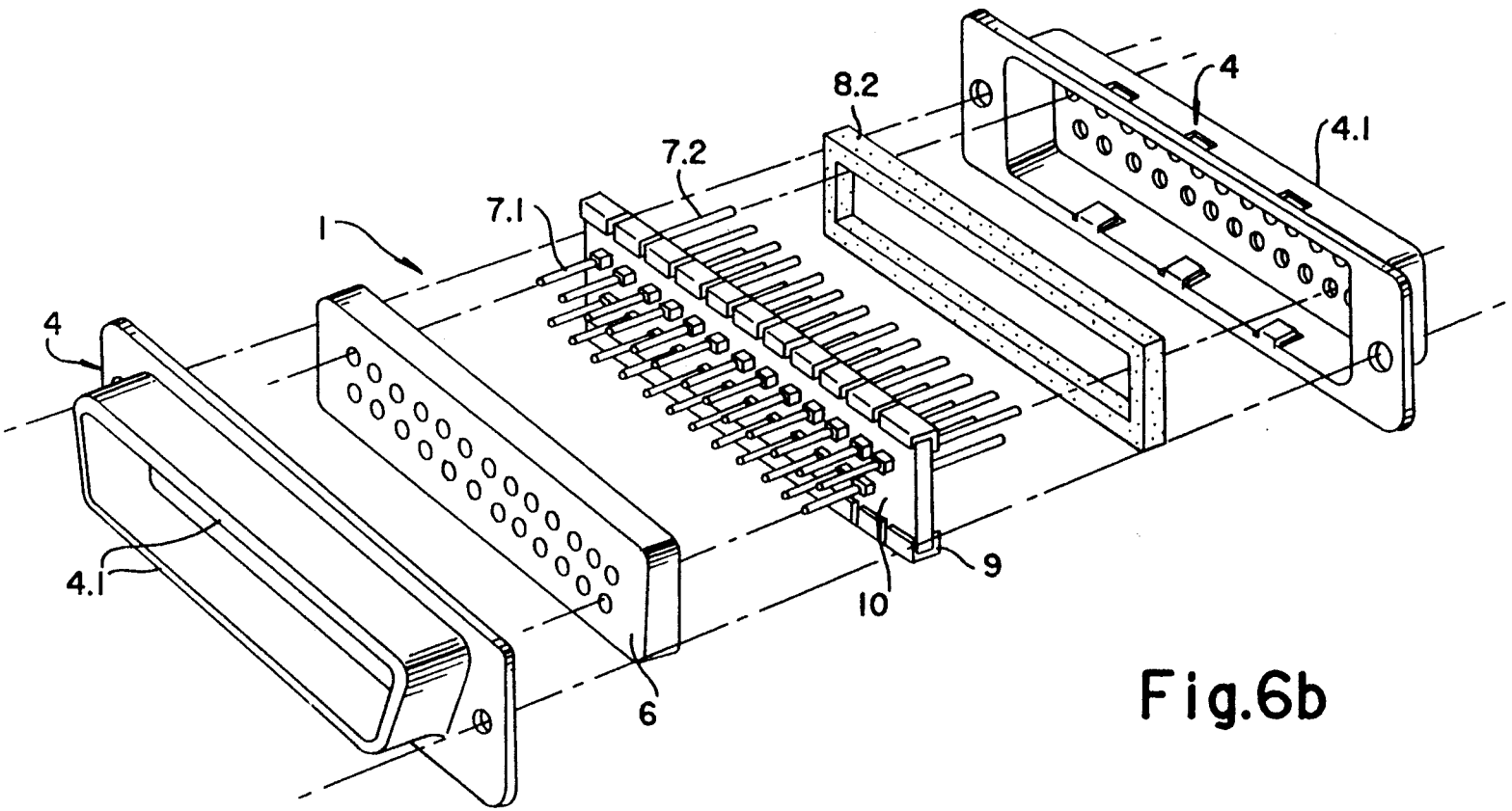
Figure 7:
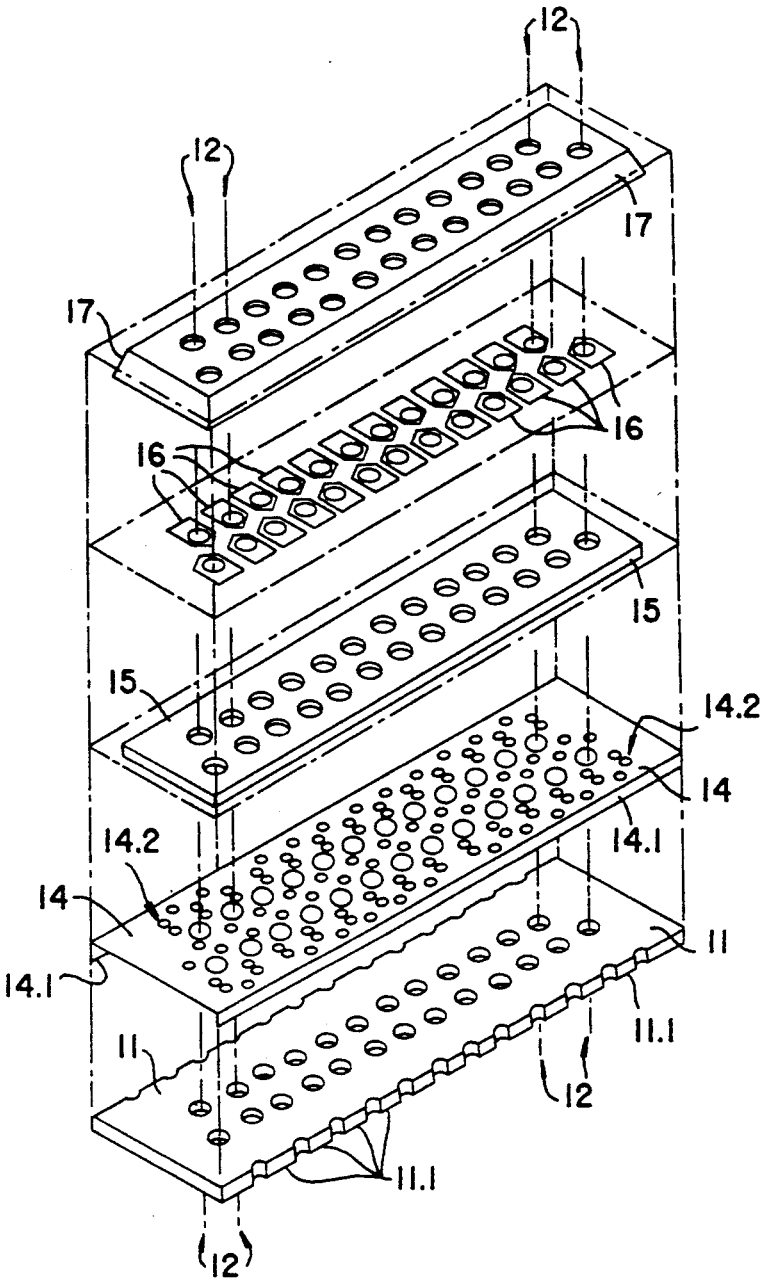
Figure 7A:
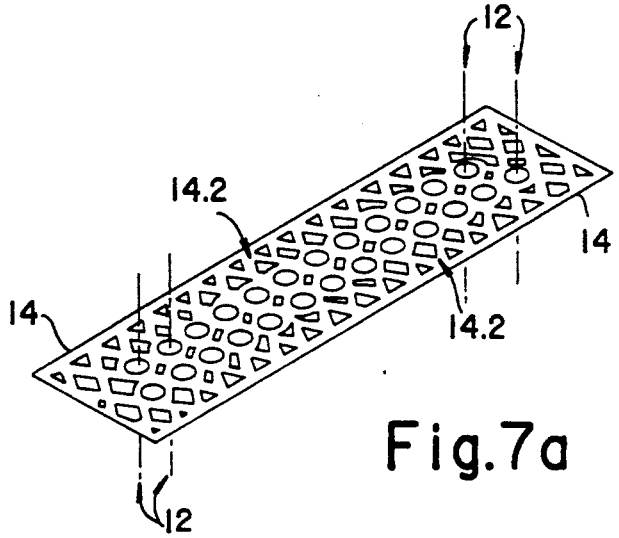
Figure 8A:
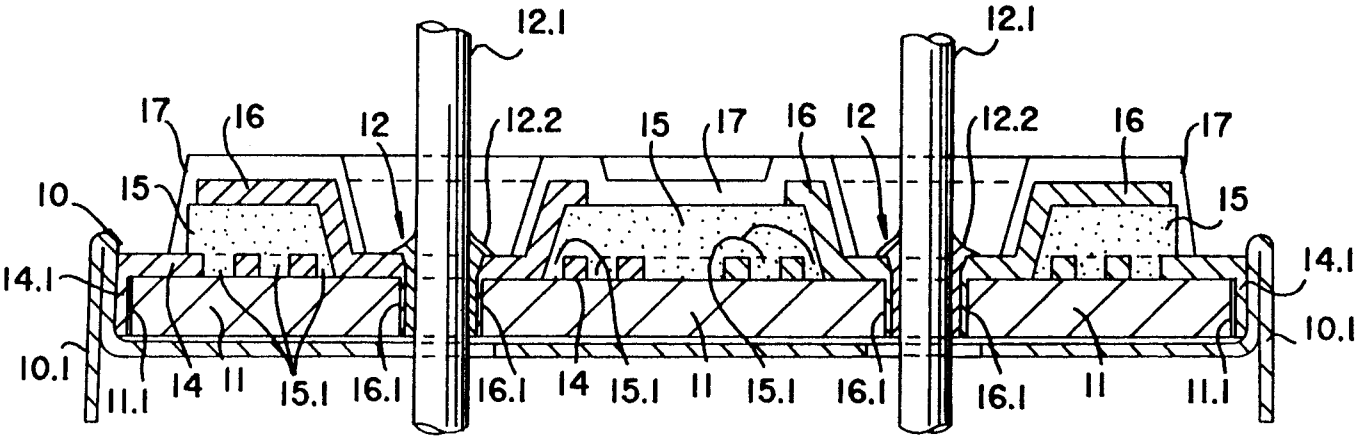
Figure 8B:
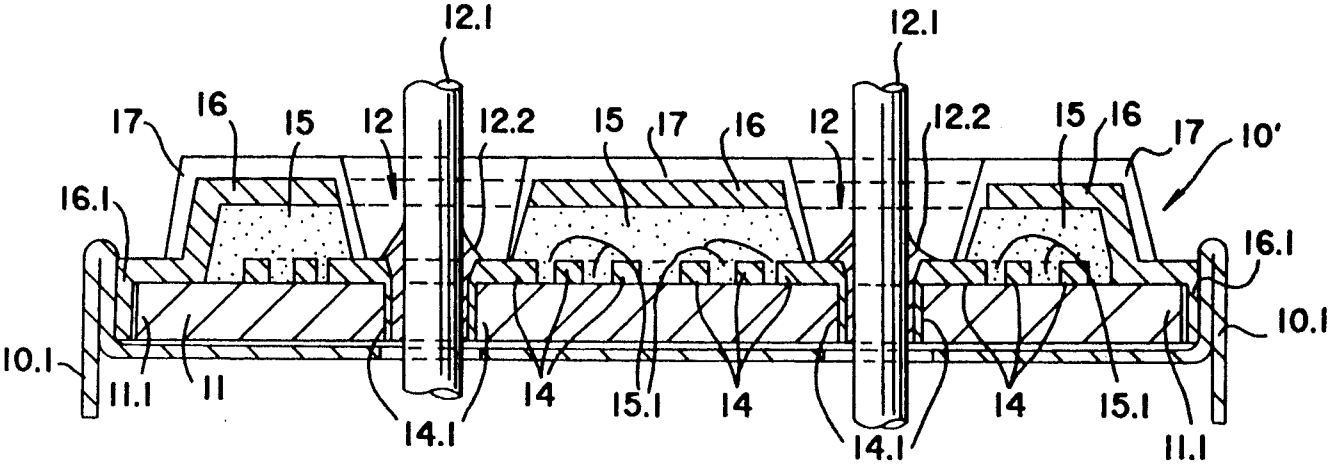
Figure 9B:
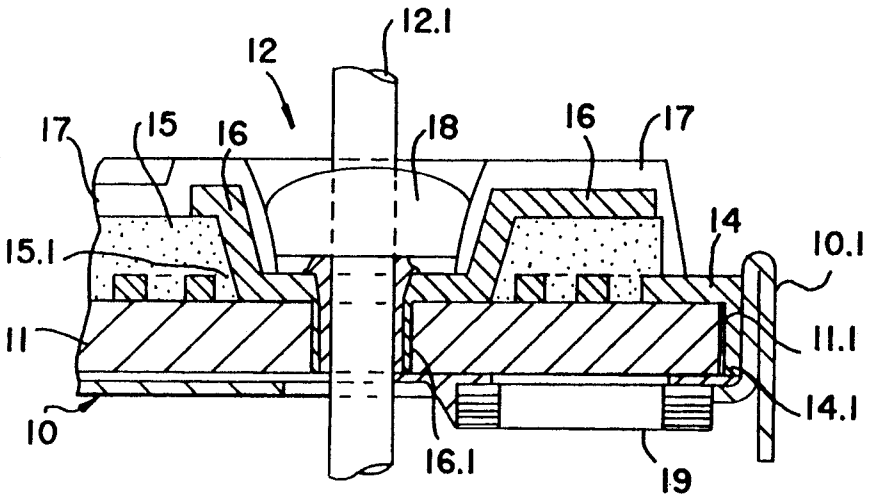
Figure 9A:
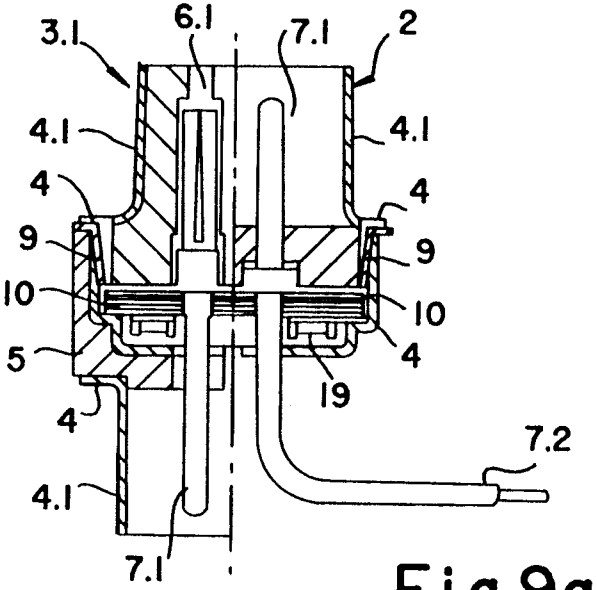

FIG. 1 is an exploded, diagrammatic, perspective view of a layout of a multipole connector, with a planar filter inserted into a filter carrier;

FIG. 2*a* is an exploded perspective view, FIG. 2*b* is an assembled perspective view and FIG. 2*c* is a cross-sectional view of a connector provided with tip jacks, with a planar filter inserted into a metal filter carrier, for being soldered to an insert card;

FIGS. 3*a*, 3*b* and 3*c* are views corresponding to FIGS. 2*a*, 2*b* and 2*c* of a connector provided with plug-in pins, with a planar filter inserted into a metal filter carrier, for being soldered to an insert card;

FIG. 4*a* is a perspective view, FIG. 4*b* is a section through a female/male adaptor plug with a filter, and FIG. 4*c* is a section through male/male adaptor plug with a filter, of an embodiment of the connector as an adaptor plug;

FIGS. 5*a*, 5*b* and 5*c* are views corresponding to FIGS. 2*a*, 2*b* and 2*c* of a connector constructed as an adaptor, with a double filter;

FIG. 6*a* is an exploded view of a connector to be soldered corresponding to FIG. 2 and FIG. 6*b* is an exploded view of a connector with plug-in pins on both sides corresponding to FIG. 3*c*, of a connector with a planar filter inserted by means of a conductive frame;

FIG. 7 is an exploded perspective view of a layout of the filter and FIG. 7*a* is a perspective view of a portion of a base electrode;

FIGS. 8*a* and 8*b* are fragmentary, sectional views of a planar filter with two rows of pins, respectively showing a ground electrode on a ceramic substrate and a signal electrode on a ceramic substrate;

FIG. 9*a* is a sectional view being split in the center into a right-hand half showing a male connector being solderable to a board and a left-hand half showing an adaptor plug with tip jacks and pins, and FIG. 9*b* is a fragmentary sectional view of a portion showing a filter with damping and voltage peak limitation, of a multipole connector with voltage peak limiters.

Referring now to the figures of the drawing in detail and first, particularly, to FIG. 1 thereof, there is seen a layout of a multipole connector 1 with tip jacks 6.1 and a multipole connector 2 with plug-in pins 7.1. Both connectors 1 and 2 are provided with a metal housing 4. The housing 4 is constructed with two shells, it receives the interior of the connector from both sides, and a ground connection can be made by way of the housing. To that end, the housing 4 has a protruding collar 4.1, which receives a female multipoint connector strip 6 having the tip jacks 6.1 or the pins 7.1 and forms their shielding. The shielding is connected to ground through the connector to be attached. Back ends of the tip jacks 6.1 are provided with connection pins 6.2, and back ends of the pins 7.1 are provided with connection pins 7.2, of signal lines 12.1 that will be discussed below, which protrude out of the housing 4 of the assembled connector and may be soldered, for instance as soldered pins, to an insert card or board. A filter carrier 9 that receives a filter 10 is inserted between the two housing shells 4. The filter carrier 9 is provided with contact tongues 9.1, which rest on a metallization 14.1 or 16.1 of a respective common electrode 14 or 16 seen in FIG. 8. The metallization is extended to at least one of outer metallized edges 11.1 of a base plate 11 of the plate-like planar filter 10, so that the contact tongues 9.1 establish an electrical connection with the filter carrier 9. The filter carrier 9, which is inserted into the metal housing 4, is in turn conductively connected to it, and the housing edge has a corresponding recess or corresponding contact tongue that achieves secure contacting by a clamping action. A pin receptacle 8.1 is also shown. FIG. 2*a*, 2*b* and 2*c* show details of a connector 1 provided with tip jacks 6.1. In the exploded view of FIG. 2*a*, a layout can be seen in which the two shells of the housing 4 have their collars 4.1 pointing outward. The female multipoint connector strip 6 that receives the tip jacks 6.1 and is adapted in shape to the shape of the associated shell of the housing 4, and the pin receptacle 8.1 that receives the connection pins 6.2, are provided between these two shells. The filter holder 9 with the non-illustrated filter is disposed between the female multipoint connector strip 6 and the pin receptacle 8.1 in such a way that each of the connecting lines is guided through the filter from one of the tip jacks 6.1 to the connection pin 6.2 associated therewith. To that end, the planar filter 10 has one opening or recess forming a duct 12 as seen in FIG. 7 for each of several signal lines or terminals 12.1 having the pins 6.2, 7.2, that are seen clearly in the enlarged view of FIG. 9*b*. The pin receptacle 8.1 simultaneously forms a support that secures the planar filter 10 which is inserted into the filter holder 9. The pin receptacle 8.1 is made from a non-conducting plastic or rubber having a Shore hardness of approximately 40° to 60°, it protects the planar filter against impact and shaking and permits it to "work" in the event of expansions in the housing arising from a temperature change. The sectional view of FIG. 2*c* shows the filter holder 9 inserted between the shells of the housing 4. The view in FIG. 2*b* shows the compactness of the multipole connector which is provided with a filter.

FIG. 3 shows the same conditions for a multipole connector 2, in which instead of the tip jacks 6.1 shown in FIG. 2, plug-in pins 7.1 are provided as plug elements. In order to provide strain relief of the filter, a pin strip 7 is provided that takes the place of the female multipoint connector strip 6. The sectional view of FIG. 3*c* shows the connection pins being angled by 90°, for being soldered to a board. Once again, the front perspective view of FIG. 3*b* shows the compactness of the multipole connector.

FIG. 4 shows an embodiment of the multipole connector as an adaptor plug 3.1. The filter carrier 9 which is connected to at least one shell of the housing 4, is disposed in the double-shelled housing 4 of the multipole connector along with the planar filter 10. The signal lines that connect the tip-jacks 6.1 or pins 7.1 to one another are extended through the pin receptacle 8.1, which forms an excellent insulator with a predeterminable dielectric constant, if it is made from an aluminum-oxide ceramic. Another option is for this pin receptacle 8.1 to be made of a ferromagnetic material, which forms a series inductance for the signal lines. As a result, each of the signal lines is provided with one inductance upstream and one inductance downstream of the capacitor, so that in this way L-type filter configurations are formed. If such ferromagnetic pin receptacles 8.1 are provided on both sides of the planar filter 10 that is disposed in the filter holder 9, then T-type filter configurations can be made. It is self-evident that the series inductances can also be formed by ferromagnetic beads or small tubes slipped onto individual signal lines. It is not necessary for every one of the signal lines to be provided with inductance. The embodiment may be in the form of a "female/male adaptor plug", that is for connecting one male plug to another male plug, as shown in the sectional view of FIG. 4*b*, or as a "male/-male adaptor plug" for connecting a female socket to a female socket as shown in FIG. 4*c*. It is self-evident that an embodiment in the form of a "female/female adaptor plug" for connecting two male plugs to one another is also possible. The layout is substantially equivalent to the layout of the multipole connectors shown in FIGS. 1–3.

FIGS. 5*a*, 5*b* and 5*c* show a multipole connector that is constructed as an adaptor 3. In contrast to the adaptor plugs 3.1 of FIG. 4, different connector configurations on the two sides of the connector and/or different line connections inside the adaptor 3 are also possible. The layout is shown in the exploded view of FIG. 5*a*. An intermediate adaptor element 5 in this case connects the two shells of the housing 4, and also establishes the through bonding of the ground connections made through the metal housing shells. To this end, at least the outside of the intermediate adaptor element 5 is metallized. This metallization, beyond the through bonding, is also provided for shielding, which effectively prevents the entry of noise signals. The internal connections are then located in this intermediate adaptor element 5 and can be routed as required. For instance, a transition from two-row connectors to three-row connectors is also possible, and the connection layout can be varied, for instance for cables to connected incompatible interfaces. The intermediate adaptor housing 5 moreover makes it possible to use two filter carriers 9, with optionally different planar filters 10, as the exploded view of FIG. 5*a* and the sectional view of FIG. 5*c* show. The front perspective view of FIG. 5*b* also again shows that with the filters, an extremely compact structure of the multipole connector is attainable.

FIGS. 6*a*, 6*b* and 6*c* are views of a filter carrier 9 which is inserted into the metal housing 4.1 with a conductive frame 8.2 and which has the planar filter 10. The conductive frame 8.2 in this case takes over the task of bonding with the housing 4.1, which is at ground potential, and thus assures a good ground connection, that is maintained even in the event of dimensional deviations or (small) deformations of the frame 8.2 due to the elasticity of the plastic or rubber having a Shore hardness of about 40° to 60°. First, FIG. 6*a* shows a connector with tip-jacks corresponding to the embodiment shown in FIG. 2 and second FIG. 6*b* shows a connector with pins corresponding to the embodiment shown in FIG. 3. Upon assembly, this frame 8.2 is squeezed because of the compression, so that the resiliently elastic plastic or rubber rests on the periphery over a large surface area and assures good, persistent bonding even in the event of deformation occurring during manipulation of the connector.

FIG. 7 is a highly diagrammatic, exploded view of the layout of the planar filter. A metal electrode layer is applied as a base electrode 14 to a base plate 11 that is formed of a ceramic and is particularly formed on the basis of aluminum oxide. The base electrode 14 fits around the base plate 11 with angular strips 14.1 and is in electrical contact, optionally by means of soldering, with advantageously likewise metallized outer surfaces 11.1 of the base plate 11. A following layer 15 is formed of a dielectric, which in particular is constructed on a titanate basis. Counter electrodes 16 that are necessary to form capacitors, are provided on the top of the dielectric layer 15 and are shown as individual electrodes in the view selected. This substantially planar layout is covered by an insulating protective coating 17, which is a plastic or a paint, so that the planar filter is protected against external factors, such as humidity or corrosive gases. All of the layers have aligned recesses forming ducts 12 in the form of holes for ducting the signal lines 12.1 seen in FIG. 8. These ducts, which are not shown in detail in FIG. 7, are shown in phantom lines in four cases in which they bear reference numeral 12. All of the ducts through the metal base electrode 14, which forms the common (ground) electrode in the illustrated exemplary embodiment, are identified by a plus sign. These ducts in the base electrode 14 are surrounded by further openings 14.2 (which need not necessary have a circular cross section), through which the dielectric layer 15 reaches as a bridge 15.1 shown in FIGS. 8*a* and 8*b*, in order to firmly anchor the dielectric layer 15 on the base plate 11. A number of such openings 14.2 is provided around each of the signal line ducts 12. Advantageously, these openings are each disposed on the center lines between the openings forming the ducts 12, which produces good symmetry. FIG. 7*a* shows a different embodiment of the base electrode 14 from that of FIG. 7. In this case, the cross-sectional shapes of the further openings 14.2 is different. Additionally, in this case, the ceramic of the dielectric layer 15 is firmly joined and quasi-anchored to the ceramic of the base plate 11 through the recesses of the holes 14.2 that are provided. This anchoring is of decisive importance for the load capacity of the connection, in particular for loads caused by strains from different thermal expansion coefficients. As FIG. 8 shows, by means of the example of a cross section through a filter for a two-row connector, the various ducts 12 for the signal lines 12.1 are constructed in such a way that the base plate 11 rests (relatively) closely on the signal line 12.1. The metallization of the base electrodes 14 is drawn into the duct 12, so that the electrical connection with the base electrodes 14 can be established by simple soldering. This is independent of whether the base electrode 14 is constructed as a common (ground) electrode as shown in FIG. 8*a*, or the base electrode 14 breaks down into individual electrodes, each of which is connected to the associated signal line 12.1 as shown in FIG. 8*b*. A dielectric layer 15, which is important to the capacitor, is provided above the base electrode 14 and through the use of bridges 15.1 it reaches through the further openings or recesses 14.2 disposed around the openings forming the ducts 12 for the signal line ducting and is directly joined to the material at the base plate 11, thus establishing a firm connection between the ceramic of the base plate 11 and the material of the dielectric layer 15. The dielectric layer 15 is recessed in cup-like fashion in the region of the ducts 12, so that indentations are produced around the ducts 12, with a soldering location 12.2 being located in the bottom of each indentation. The soldering location creates the connection between the corresponding signal line 12.1 and the individual electrode. The exposed top of the dielectric layer 15 carries the counter electrode 16, which in turn is covered by the protective coating 17. The thus-structured planar filter 10 or 10' is inserted into a metal filter holder 10.1, which is electrically conductively connected to the preferably metallized edges 11.1 of the base plate 11 by the contact strips 14.1 or 16.1, and which in turn is inserted into the filter carrier 9 seen in FIGS. 1–5.

In FIG. 8*a*, the base electrode 14 is shown as a continuous common electrode, which is introduced on both long sides as far as the inside of outer surfaces or edges 11.1 of the base plate 11, which are preferably provided with a metal overlay and thus produce the metallizations or contact strips 14.1, with which the ground connection is established through the filter carrier 9 and the housing 4 of the connectors of FIGS. 1–5. In this case, the counter electrode 16 is constructed as an individual electrode, which surrounds each of the ducts 12 for the signal lines 12.1 in island-like fashion, so that one electrode is available for each of the signal lines 12.1. This electrode 16 extends past the edge of the cut-like indentation surrounding the duct 12 in the dielectric layer 15 and thus reaches the bottom of each of the ducts 12 and is capable of being connected to the signal line 12.1 by means of the solder location 12.2. It is self-evident that the recesses surrounding the duct 12 in the base electrode must have a correspondingly large diameter so as to maintain adequate spacing from the counter electrodes that are extended as far as the surface of the base plate 11 in the duct region and are introduced as contact strips 16.1 into the holes of the ducts. FIG. 8*b* shows the reverse, in which the counter electrode forms the continuous, common electrode, that is extended as far as the edges 11.1 of the base plate 11 on both long sides and forms the metallization or contact strip 16.1 establishing the ground contact. The base electrode 14 is split into individual electrodes, and is introduced into each of the recesses of the base plate as a metallization or contact strip 14.1 for soldering to the associated signal line 12.1. In this case, the individual electrodes of the base electrode 14 surround the signal line ducts in island-like fashion.

FIGS. 9*a* and 9*b* show an embodiment in which some or all of the ducted signal lines 12.1, which connect the tip jacks 6.1 and pins 7.1 (or which connect jacks to jacks or pins to pins) of an adaptor plug or pins 7.1 and connection pins 7.2 (or tip jacks-connection pins) of a solderable connector, are especially protected against voltage peaks by means of a voltage peak suppressor 19, for instance in the form of Zener or avalanche diodes, which is in particular soldered on by SMD technology. These components can also be accommodated in the housing 4 of the multipole connector. Moreover, the damping of some or all of the signal lines 12.1 by means of a damping bead 18 that is slipped onto them and, for instance, is made of a ferromagnetic ceramic, can be varied in such a way that particularly in cooperation with the capacitor of the filter, its limited frequency can be shifted in a desired manner. The damping bead is advantageously constructed in such a way that it is received by the cup-like indentation in the dielectric layer 15 and is embedded in the protective coating or paint 17. This configuration is shown on a larger in FIG. 9*a*. For additional series damping, a ferromagnetic bead 18 is slipped onto the signal line 12.1.

I claim:

1. A multipole connector, comprising:

a housing having at least one conductive shell;

signal lines extending through said housing and having pins;

a base plate being disposed in said housing and being formed of a material selected from the group consisting of aluminum-oxidic and ferromagnetic ceramic;

a planar filter mounted on said base plate in said housing;

said planar filter having one capacitor for each of said pins of at least some of said signal lines, said capacitors being formed by a base electrode applied to said base plate, a dielectric layer applied onto said base electrode, and a counter electrode applied onto said dielectric layer, one of said electrodes being continuously constructed as a ground electrode and being conductively connected to said housing, the other of said electrodes being divided into individual signal electrodes and being conductively connected to said signal lines;

said base plate, said dielectric layer and at least one of said electrodes having openings formed therein forming ducts for said signal lines;

said base electrode having further openings formed therein around and in the vicinity of said ducts; and said dielectric layer having bridges extending through said further openings and being in communication with and anchored to the material of said base plate.

2. The multipole connector according to claim 1, wherein said further openings in said base electrode surround said openings forming said ducts in a grid.

3. The multipole connector according to claim 2, wherein said further openings are located on center lines of two adjacent ducts.

4. The multipole connector according to claim 1, wherein said base plate has at least one edge, said continuous electrode is formed of a metallization being extended up to said at least one edge of said base plate for forming a corresponding contact strip, and said individual signal electrodes connected to said signal lines are formed of a metallization being extended as far as a location inside said openings forming said ducts for forming corresponding contact strips, and including a metal filter carrier having contact tongues for holding said planar filter, said contact tongues, pressing on said edges of said base plate for establishing electrical contact with said continuous electrode.

5. The multipole connector according to claim 4, wherein said at least one edge of said base plate is metallized.

6. The multipole connector according to claim 4, wherein said metallization extended up to said at least one edge for forming said contact strip is formed of melted-on solder paste.

7. The multipole connector according to claim 6, including a layer of an electrically conductive paint covering at least said metallized edges.

8. The multipole connector according to claim 4, wherein said at least one conductive shell of said housing is two shells, and said filter carrier is inserted and locked into at least one of said shells for electrically conductively interconnecting said carrier and said at least one housing shell.

9. The multipole connector according to claim 4, including inlays formed of a material selected from the group consisting of electrically conductive plastic and electrically conductive rubber, said inlays being disposed between said filter carrier with said planar filter inserted and said at least one shell of said housing.

10. The multipole connector according to claim 9, wherein said inlays form an encompassing frame resting on edge regions of said planar filter.

11. The multipole connector according to claim 9, wherein said planar filter inserted into said filter carrier has a covering on at least one side being formed of a material selected from the group consisting of plastic and rubber, said covering being perforated to match a pattern of said pins.

12. The multipole connector according to claim 1, wherein:

said base plate has an edge and a surface at a given height, said base electrode is said continuous ground electrode being continuous up to said edge of said base plate and having an edge forming a contact strip, said counter electrode for each of said signal lines is drawn inward in an approximately cup-like shape up to said given height in the vicinity of said ducts and is extended up to a location in said ducts in the form of a contact strip for connection with said signal lines, and said further openings in said base electrode for said bridges said bridges surround said ducted signal lines and are spaced apart in an approximately grid-like shape.

13. The multipole connector according to claim 12, wherein said edge of said base plate is metallized.

14. The multipole connector according to claim 12, including a filter carrier connected to said base electrode forming said continuous ground electrode.

15. The multipole connector according to claim 12, including an inlay formed of a material selected from the group consisting of conductive plastic and rubber being connected to said base electrode forming said continuous ground electrode.

16. The multipole connector according to claim 1, wherein said base plate has a given height and an edge, said base electrode is subdivided into individual electrodes and is extended in the vicinity of said ducts up to a location in said ducts forming contact strips of said signal electrodes for connection with said signal lines, said counter electrode is said continuous ground electrode, is drawn inward in edge regions approximately in the shape of a shallow cake pan up to said given height and extends to said edge of said base plate forming a contact strip, and said recesses formed in said counter electrode are spaced apart and surround said signal lines.

17. The multipole connector according to claim 16, wherein said edge of said base plate is metallized.

18. The multipole connector according to claim 16, including a filter carrier connected to said counter electrode forming said continuous ground electrode.

19. The multipole connector according to claim 16, including an inlay formed of a material selected from the group consisting of conductive plastic and rubber being connected to said counter electrode forming said continuous ground electrode.

20. The multipole connector according to claim 1, including an insulating coating covering said counter electrode.

21. The multipole connector according to claim 20, including soldering connections disposed in said openings forming said ducts for said signal lines.

22. The multipole connector according to claim 4, including voltage-peak-suppressing switch elements for at least some of said signal lines.

23. The multipole connector according to claim 22, wherein said voltage-peak-suppressing switch elements are soldered into place on a side of said base plate facing away from said capacitors, between said contact strip on its edge and said contact strip of said duct of said signal line.

24. The multipole connector according to claim 22, wherein said voltage-peak-suppressing switch elements are selected from the group consisting of Zener or avalanche diodes and varistors.

25. The multipole connector according to claim 5, wherein at least some of said signal lines on at least one side of said planar filter disposed in said filter holder have a damping element increasing a series inductance to form a filter configuration of a type selected from the group consisting of L-type or T-type.

26. The multipole connector according to claim 25, wherein said damping element is a ferrite bead.

27. The multipole connector according to claim 25, wherein said signal lines are disposed on both sides of said planar filter.

28. The multipole connector according to claim 25, wherein said damping element increasing said series inductance is a pin receptacle being formed of a ferromagnetic material.

29. The multipole connector according to claim 28, wherein said ferromagnetic material is a ferromagnetic ceramic.

30. The multipole connector according to claim 1, wherein said at least one conductive shell of said housing is in the form of a first and a second shell, and including plug-type connections disposed in said shells for said signal lines being formed of at least one of plug-in pins and tip jacks.

31. The multipole connector according to claim 30, wherein said signal lines are connected in a variable connection pattern for varying occupation of said signal lines in an adaptor plug or an adaptor.

32. The multipole connector according to claim 30, including electronic components forming adaptation elements at least in some connections between said signal lines of said first shell and said signal lines of said second shell of said housing.

33. The multipole connector according to claim 30, including another planar filter, each of said planar filters being disposed in a respective one of said shells of said housing, and at least some of said signal lines having additional ferromagnetic damping elements between said planar filters in the form of hollow cores or beads increasing their series inductance and being disposed between transverse capacitors, forming a pi-type filter being effective for said signal line.

* * * * *